US011097821B1

(12) United States Patent
Schultz

(10) Patent No.: US 11,097,821 B1
(45) Date of Patent: Aug. 24, 2021

(54) DEBRIS PROTECTIVE FITTING FOR A JET INTAKE OF AN OUTBOARD JET MOTOR

(71) Applicant: James F. Schultz, Williamsville, MO (US)

(72) Inventor: James F. Schultz, Williamsville, MO (US)

( * ) Notice: Subject to any disclaimer, the term of this patent is extended or adjusted under 35 U.S.C. 154(b) by 99 days.

(21) Appl. No.: 16/738,238

(22) Filed: Jan. 9, 2020

Related U.S. Application Data

(60) Provisional application No. 62/790,223, filed on Jan. 9, 2019, provisional application No. 62/804,870, filed on Feb. 13, 2019.

(51) Int. Cl.
*B63H 11/01* (2006.01)
*B63H 20/00* (2006.01)

(52) U.S. Cl.
CPC ..... *B63H 11/01* (2013.01); *B63H 2020/008* (2013.01)

(58) Field of Classification Search
CPC ..... B63H 11/00; B63H 11/01; B63H 20/00; B63H 2020/008
USPC ..... 440/38, 46, 71, 72
See application file for complete search history.

(56) References Cited

U.S. PATENT DOCUMENTS 3,082,732 A 3/1963 Stallman
3,279,414 A 10/1966 Rabald
3,343,368 A 9/1967 Castoldi
3,797,447 A 3/1974 Stubblefield
4,027,617 A 6/1977 Ikeda et al.
4,872,858 A * 10/1989 Hasegawa ..... B63H 11/08 440/38
5,577,941 A 11/1996 Chartier
5,876,258 A 3/1999 Gray
6,083,063 A 7/2000 Neisen
6,183,319 B1 2/2001 Ishigaki
6,283,805 B1 9/2001 Ishigaki
6,482,055 B1 11/2002 Freitag
6,752,671 B2 6/2004 Ishigaki et al.
7,377,826 B1 5/2008 Wengren, Jr.
2012/0178318 A1 7/2012 Rasidescu et al.

* cited by examiner

*Primary Examiner* — Daniel V Venne
(74) *Attorney, Agent, or Firm* — Grace J. Fishel

(57) ABSTRACT

A debris protective fitting for a jet inlet of a outboard jet motor with stationary grill bars across the jet intake in front and rear slots with empty front slots provided between the stationary grill bars. Movable grill bars are supported across the jet intake in the empty front slots and a heel plate. The heel plate cups a rear of the jet intake and includes a center mounted stud for attachment of a push-pull cable for rotating the movable grill bars into alignment with the stationary grill bars forming a screen across the jet intake opening. As the movable grill bars are rotated away from the jet intake opening, the spacing between the bars in the screen is doubled causing rocks and other debris to be dislodged and fall out. Cleaning of the screen is thus accomplished without stopping the outboard jet motor or getting out of the jet boat.

10 Claims, 6 Drawing Sheets

DEBRIS PROTECTIVE FITTING FOR A JET INTAKE OF AN OUTBOARD JET MOTOR

BACKGROUND OF THE INVENTION

Field of the Invention

The present invention relates to an improved cable operated rock clean-assembly for a jet intake of an outboard jet motor.

Brief Description of the Prior Art

Outboard jet motors were developed in the early 60s for the purpose of running in shallow water. However, when running through shoals rocks and other debris may be ingested through the jet intake into the pump casing and damage the impeller. This problem lead to the development of protective water inlet fittings. Such fittings typically include a stationary grill bar assembly guarding the jet intake from rocks and other debris. Other systems include a rotatable grate bar assembly which is spring biased closed and opened with a side lever. With both systems, occasionally rocks and other debris becomes wedged between the bars. When that happens, the clean flow of water into the jet pump is restricted and cavitation results. The cavitation causes loss of power and vibrations that can damage the motor.

A problem with a stationary grill bar assembly is that the boat must be stopped and the jet motor lifted out of the water for manual cleaning of the grill bar assembly by the operator from outside the boat. A spring biased rotatable grate bar assembly is a step towards solving the problem with a stationary grill bar assembly but the boat must still be stopped in order to operate the lever in a safe manner. In addition, the side lever leads to alignment problems. Moreover, as the springs wear the rotatable grate bar assembly may not close tightly against the jet intake causing destructive vibration and motor failure.

There are still other water inlet fittings specifically designed for weed removal on the intake of inboard jet motors but they are not workable on outboard jet motors.

BRIEF SUMMARY OF THE INVENTION

In view of the above, it is an object of the present invention to provide a protective fitting that may be used on new and old jet intakes. It is another object to provide a fitting that allows an operator to clean the protective fitting from inside a jet boat. Other objects and features of the invention will be in part apparent and in part point out hereinafter.

In accordance with invention, a debris protective fitting for a new or used jet intake of an outboard jet motor has (1) stationary grill bars supported in spaced substantially parallel disposition across the jet intake in front and rear slots with the front slots including empty front slots between adjacent grill bars and (2) a grill bar assembly with movable grill bars supported in spaced substantially parallel disposition across the jet intake in the empty front slots in the jet intake and a heel plate that cups around a rear of the jet intake. A front cross pin passing through a front end of the stationary grill bars and the front end of the movable grill bars in the front slots and a rear cross pin passing through a rear end of the stationary grill bars in the rear slots. The heel plate is configured for attachment to a push-pull cable for rotating the grill bar assembly around the front cross pin between open and closed position with respect to the jet intake.

In some cases the heel plate is L-shaped with a toe and a spine. The movable grill bars are welded in slots provided in the toe of the heel plate and a stud is mounted on a centerline of the grill bar assembly and on an outboard side of the spine to which the push-pull cable is attached.

In other applications where the jet intake has a flange through which the jet intake is bolted to a jet pump casing of the outboard jet motor, the fitting includes a bracket through which the push-pull cable passes with the bracket attached to the flange above the grill bar assembly and off centerline thereof to accommodate spacial requirement imposed by the jet pump casing.

In a preferred embodiment the push-pull cable includes a swivel and is attached through a spherical rod end to the stud.

In another aspect the heel plate may be a channel with a front wall having slots in which the stationary bars are received when the grill bar assembly is rotated closed and the lever is a hand lever with a tensioning adjustment. In this case, the rear end of the stationary bars may be notched such that the grill bar assembly rotates flush with the jet intake.

The bracket is Z-shaped in some cases with a spine and upper and lower arms, with the upper arm angled downwardly and rotated with respect to the spine such that the push-pull cable, although slightly angled, applies a substantially vertical force on the grill bar assembly.

In some but not all embodiments the movable grill bars aligned with the empty front slots in the jet intake are configured such that they only partly enter the empty front slots. In view of the above, it is an object of the present invention The invention summarized above comprises the constructions hereinafter described, the scope of the invention being indicated by the subjoined claims.

BRIEF DESCRIPTION OF THE SEVERAL VIEWS OF THE DRAWINGS

In the accompanying drawings, in which several of various possible embodiments of the invention are illustrated, corresponding reference characters refer to corresponding parts throughout the several views of the drawings in which.

DETAILED DESCRIPTION OF AT LEAST ONE PREFERRED EMBODIMENT OF THE INVENTION

Figure 14:
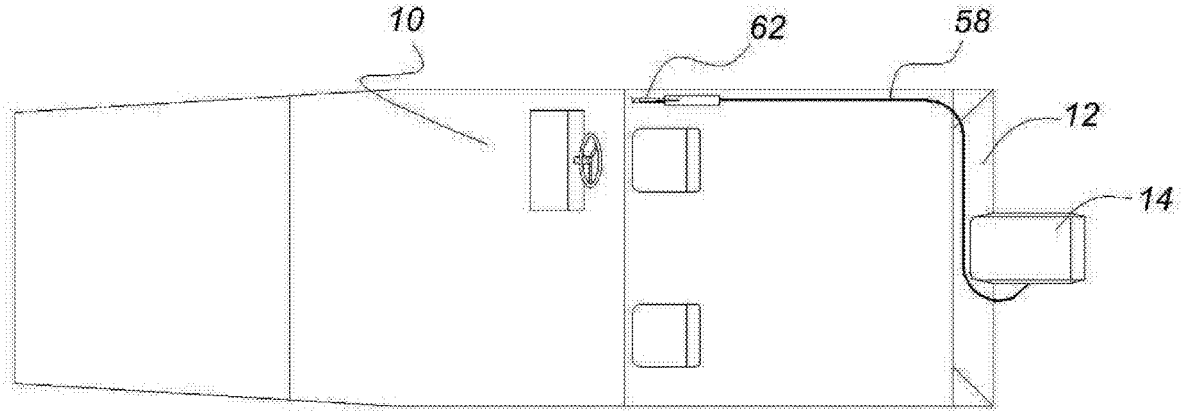
FIG. 14 is a plan view of a jet boat with a outboard jet motor.
Figure 15:
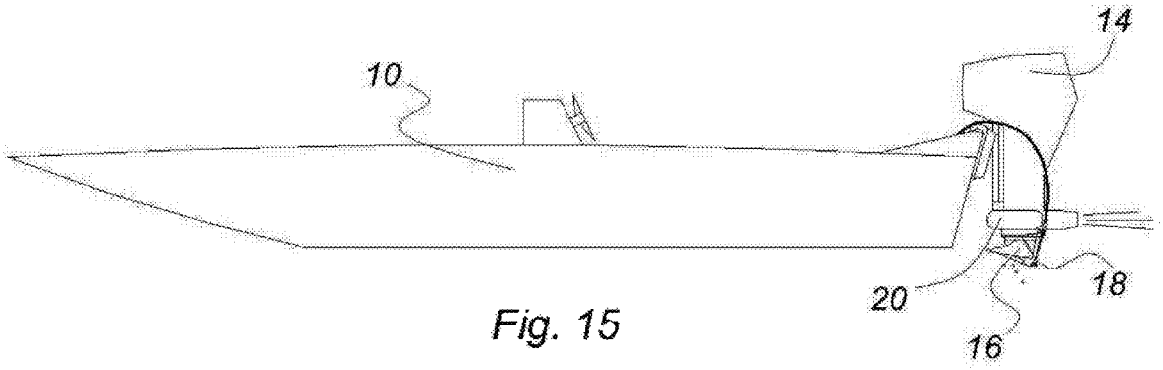
FIG. 15 is a side elevation thereof.

Referring to the drawings more particularly by reference character and beginning with FIGS. 14-15, the numeral 10 generally designates a conventional form of boat including a transom 12 upon which a convention outboard jet motor 14 is mounted. Outboard jet motor 14 has a jet intake 16 with a flange 18 through which it is bolted to a jet pump casing 20 of the outboard jet motor 14.

Turning to FIGS. 1-7, jet intake 16 has a stationary grill 22 comprising a first plurality of spaced apart grill bars 24, hereinafter referred to as stationary grill bars, are supported in spaced substantially parallel disposition across the jet intake in slots 26. Each of stationary grill bars 24 has relatively broad sides and relatively narrow sides. The narrow sides lie transversely of the direct flow of water through jet intake 16 and the broad sides of adjacent bars are disposed in confronting relation to each other. Stationary grill bars 24 are retained in slots 26 by front and rear cross pins 28, 30, respectively, which extend through holes 32 in the opposite ends of each bar. Empty slots 34 are provided between adjacent stationary grill bars 24 and flank the outermost.

The stationary grill and cross pin assembly with all slots 26 filled with stationary grill bars 24 shown in FIGS. 8-11 is prior art. The present invention makes use of that structure in attaching a grill bar assembly 36 as described below with empty slots 34 providing an attachment point.

Figure 1:
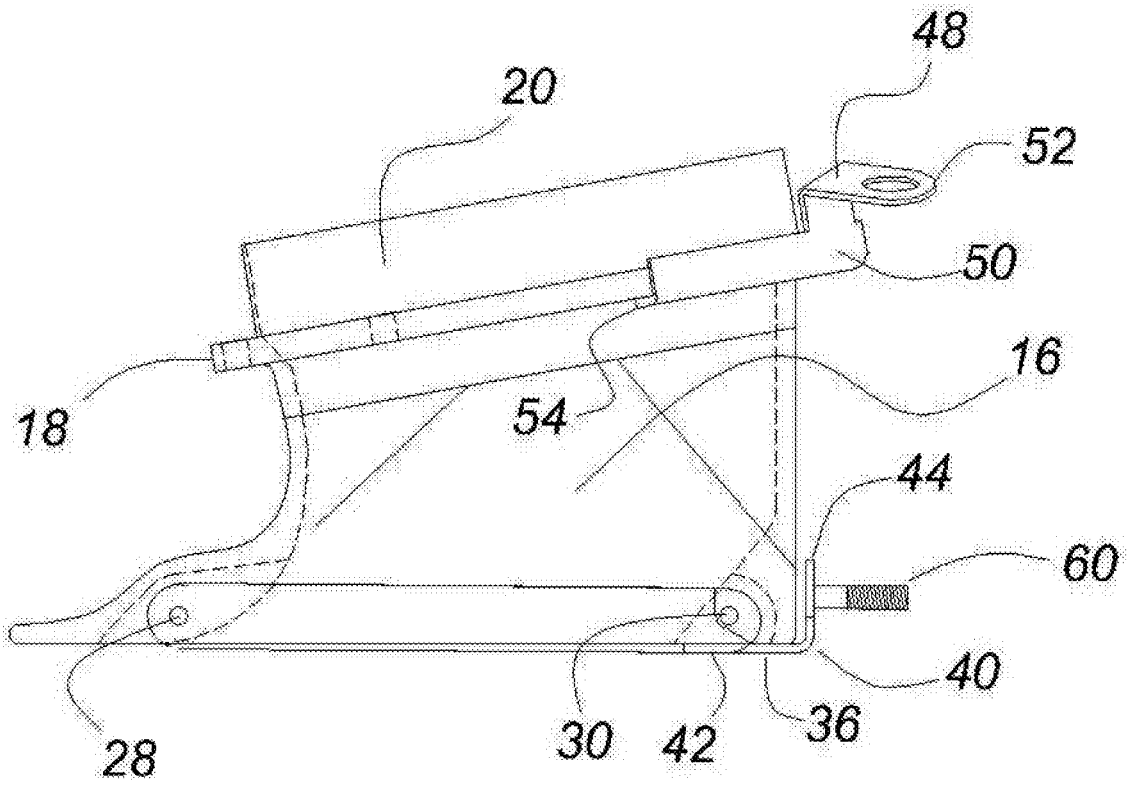
FIG. 1 is a side elevation of a cable operated grill bar assembly mounted on a jet intake of an outboard jet motor in closed position.
Figure 2:
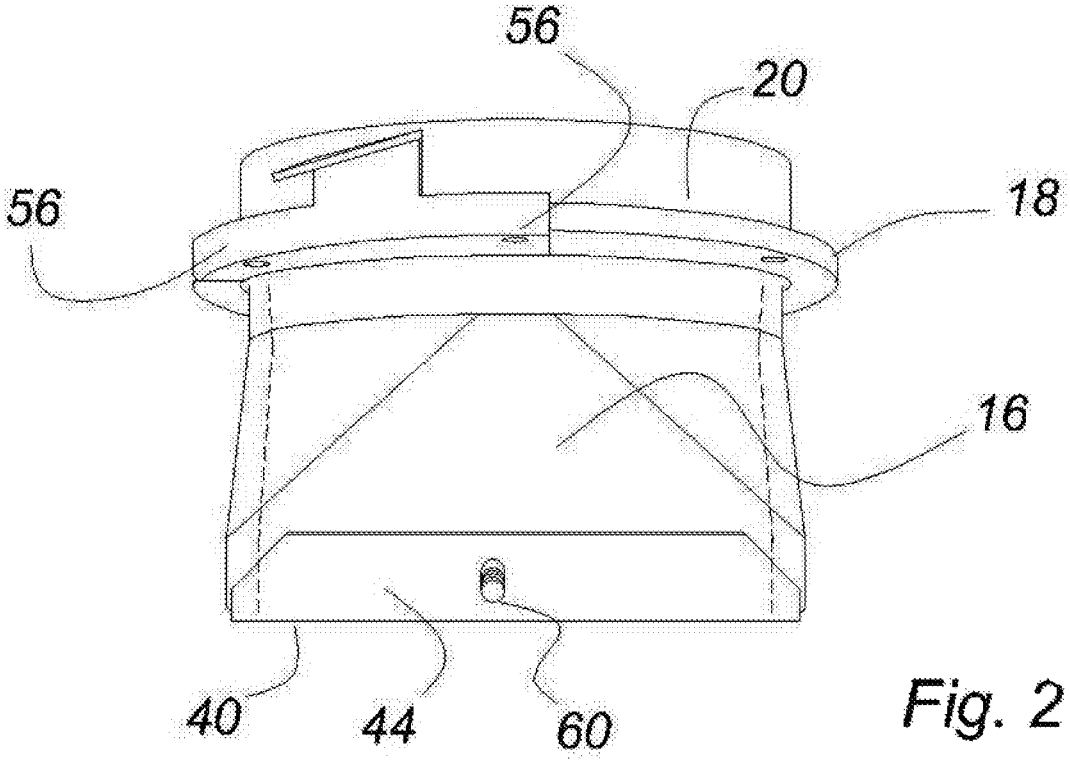
FIG. 2 is a rear view thereof.
Figure 3:
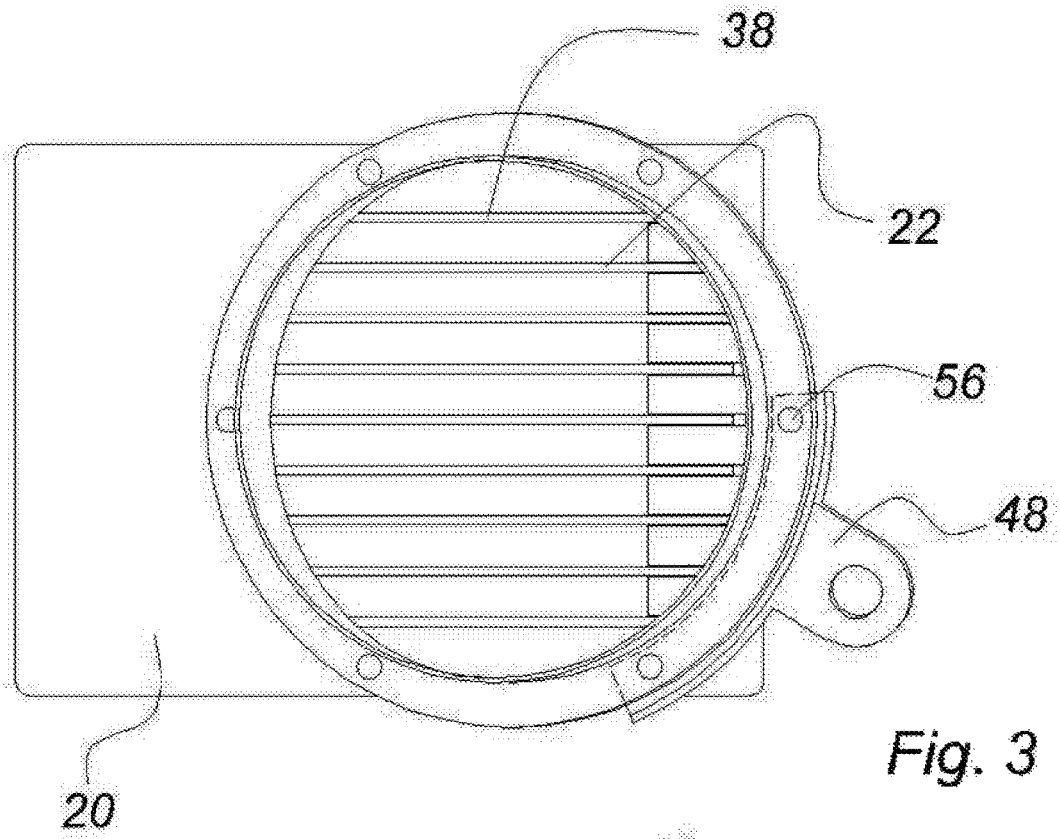
FIG. 3 is a top view thereof.
Figure 4:
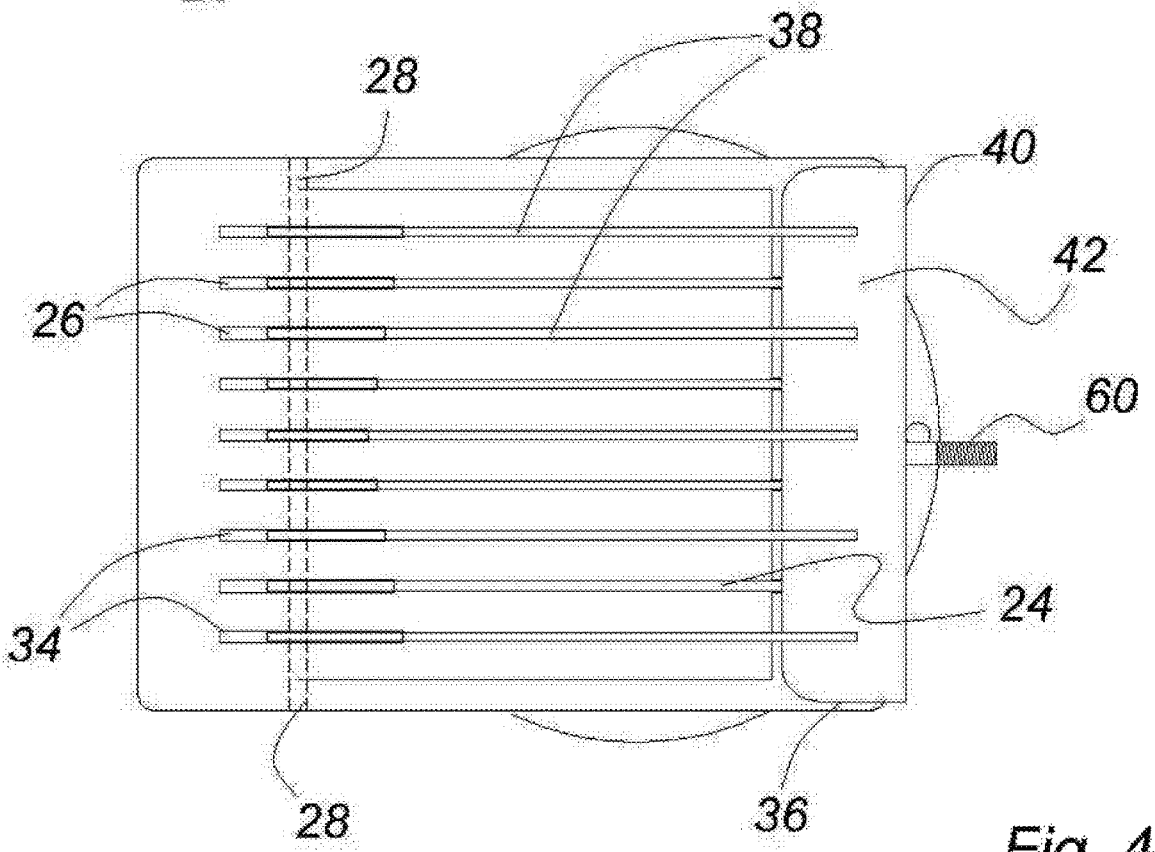
FIG. 4 is a bottom view thereof.
Figure 5:
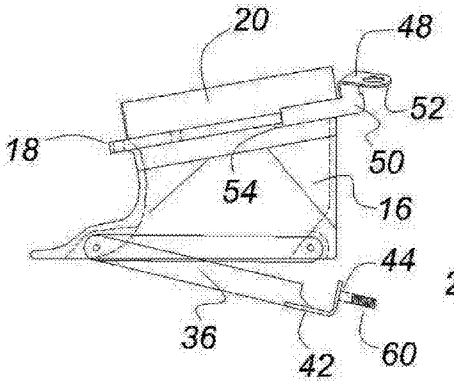
FIG. 5 is a side elevation of the cable operated grill bar assembly in open position.
Figure 6:
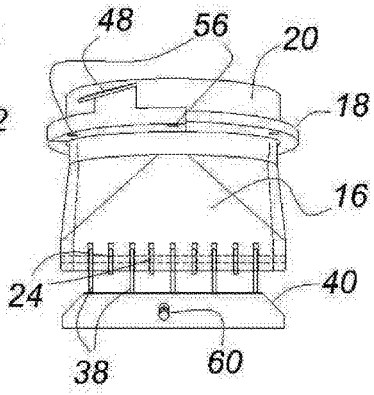
FIG. 6 is a rear view thereof.
Figure 7:
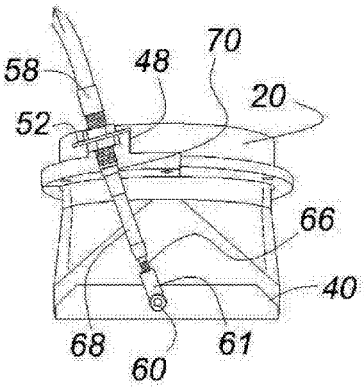
FIG. 7 is a rear view of the mounted assembly in closed position.
Figure 8:
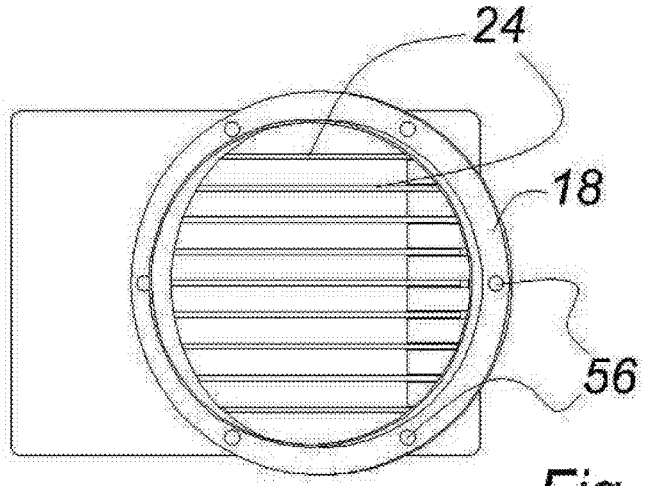
FIG. 8 is a top view of a prior art stationary grill bar assembly mounted on a jet intake of an outboard jet motor.
Figure 9:
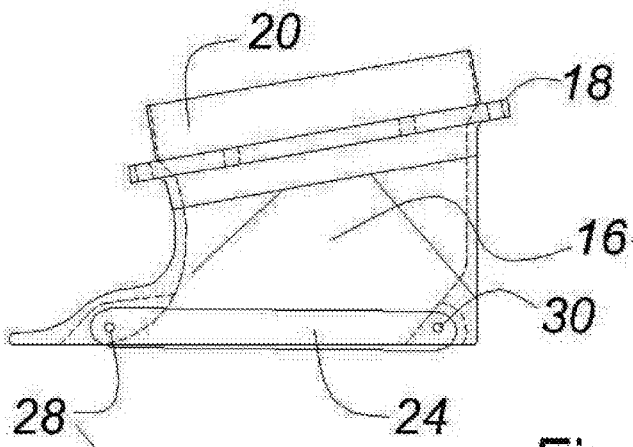
FIG. 9 is a side elevation thereof.
Figure 10:
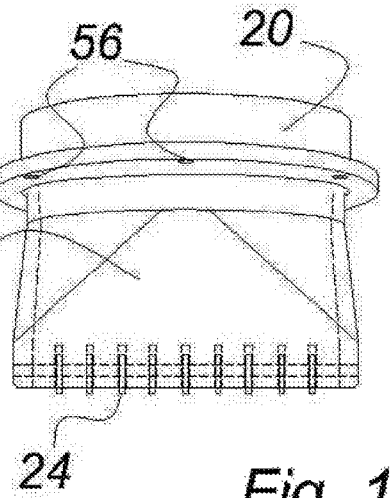
FIG. 10 is a rear view thereof.
Figure 11:
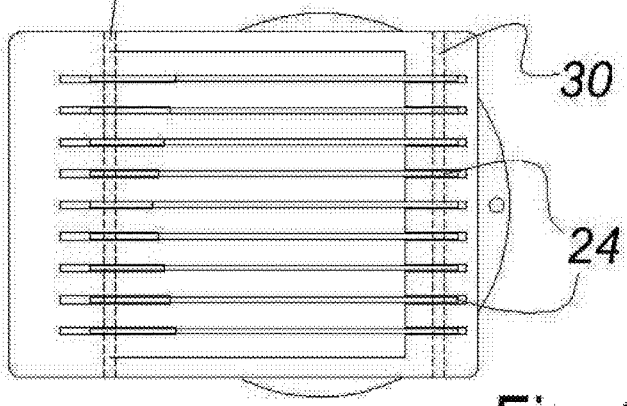
Fig. 11 PRIOR ART
FIG. 11 is a bottom view thereof.

Grill bar assembly 36 comprises a second plurality of spaced apart grill bars 38, hereinafter referred to as movable grill bars. A narrow side of movable grill bars 38 lies transversely of the direct flow through jet intake 16 and broad sides of adjacent bars are disposed in confronting relation to each other. Movable grill bars 38 are supported in spaced substantially parallel disposition between a heel plate 40 and empty slots 34 on front cross pin 28. As best seen in FIG. 5, heel plate 40 is generally L-shaped with a foot 42 and spine 44. Movable grill bars 38 are attached to foot 42 and spine 44 cups around the rear of jet intake 16 to protect it from being damaged by impacting rocks and the like in the shallow water. To this end, slots are provided in foot 42 into which the rear ends of movable grill bars 38 are welded for attachment. As grill bar assembly 36 is rotated on front cross pin 28 as shown in FIG. 5-7, movable grill bars 38 interleaf with stationary grill bars 24 to form a grill bar screen.

A Z-shaped attachment bracket 48 with a spine 50 and upper and lower arms 52, 54, respectively, is bolted at lower arm 54 to the underside of flange 18 using longer bolts 56 than those used to bolt jet intake 16 to jet pump casing 20. Spine 50 conforms to the periphery of flange 18 and upper arm 52 provides an attachment point for a push-pull cable 58 to a stud 60 provided on an outboard side of heel plate 40. As shown stud 60 is located generally on centerline of grill bar assembly 36 to avoid stressing the hinge provided by front cross pin 28.

To accommodate spatial requirements imposed by jet pump casing 20 on conventional outboard jet motors 14, bracket 48 is displaced on flange 18 from centerline of grill bar assembly 36. As shown upper arm 52 is angled downwardly and rotated with respect to spine 50 such that push-pull cable applies as close as possible to a vertical force on grill bar assembly 36 through the stroke of a hand or foot lever 62 mounted on boat 10. Push-pull cable 58 is attached to bracket 48 with a bulk head fitting and includes a swivel 70 which allows a necessary several degree pivot of the cable with respect to upper arm 52. For this purpose push-pull cable 58 between upper arm 52 and stud 60 further includes a slider 66 rotatably attached to stud 60 with a spherical rod end 61 and a free end of slider 66 reciprocates in a slider guide 68.

Second end of push-pull cable 58 extends to lever 62 located on transom 12, a steering seat or other location selected by an operator such that grill bar assembly 36 is operable by lever 62 via the cable. In a preferred embodiment, lever 62 is an emergency brake lever with a tensioning adjustment such as used on fork lifts for providing a secure closing pressure on grill bar assembly 36.

Figure 12:
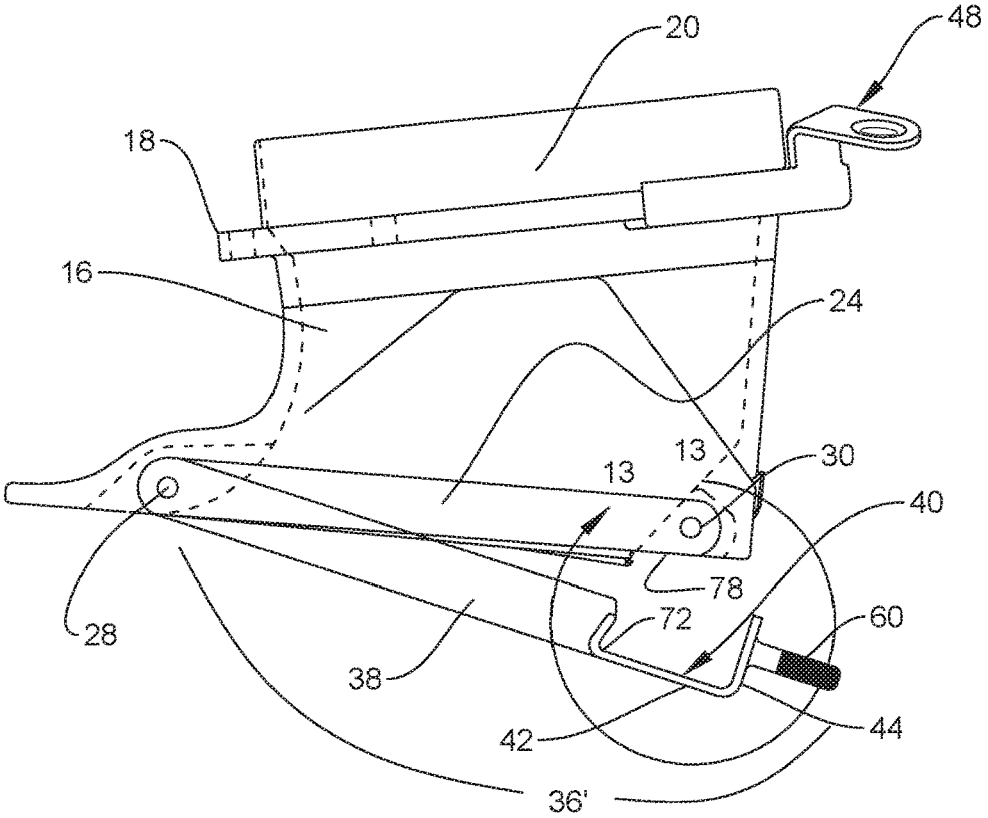
FIG. 12 is a side view of another cable operated grill bar assembly mounted on a jet intake of an outboard jet motor in open position.
Figure 13:
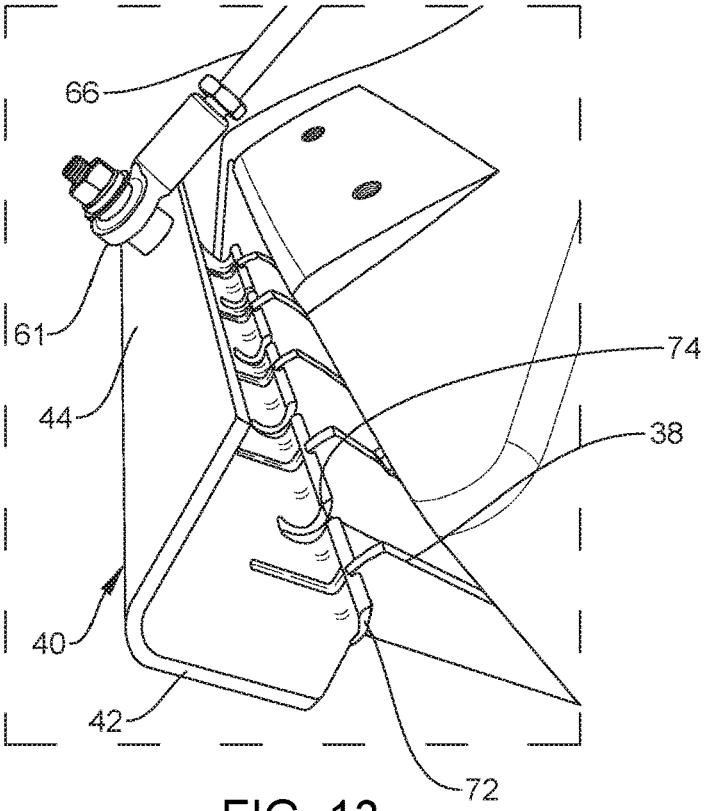
FIG. 13 is a detail taken along the line of 13-13 in FIG. 12.

In an embodiment shown in FIGS. 12-13, a front wall 72 is added to foot 42 of heel plate 40 to form a channel. The front wall 72 of the channel is provided with a plurality of slots 74 with open slots 76 between slots in which movable grill bars 38 are attached as by welding. The broad side of movable grill bars 38 is preferably shorter than in the previously described embodiment such that when the movable grill bars are interleaved with stationary grill bars 24 the movable grill bars 38 do not enter empty slots 34 between stationary grill bars 24 for smoother operation. Whereas stationary grill bars 24 are received in open slots 76 in front wall 72 of heel plate 40 to better hold the stationary grill bars 24 in place in closed position. For close fit in closed position stationary grill bars 24 are notched at 78 to allow grill bar assembly 36 to close all the way.

Grill bar assembles 36 may be used to retrofit original jet intakes 16 made of aluminum and replacement jet intakes 16 made of UHMW polyethylene which is more resistant to abrasion and lighter than aluminum, polyurethane and forth. Further, grill bar assembles 36 may be provided by OEMs as an integral part of outboard jet intake 16.

From the above, it is apparent that cable operated grill bar assembly 36 may be easily used on jet intakes 16. If the installation in on a jet intake having a stationary grill bar assembly, the front and rear cross pins 28, 30 are pulled which releases all of the stationary grill bars. Starting with an empty slot, stationary grill bars 24 are installed on rear cross pin 30, leaving empty slots 34 between adjacent stationary grill bars 24.

With grill bar assembly 36 prefabricated and with the front end of movable grill bars 38 inserted into empty slots 34, front cross pin 28 is inserted through holes in the front ends of stationary grill bars 24 and movable grill bars 38.

Either now or previously, bracket 48 is attached to flange 18. For this existing bolts or nuts on threaded studs joining jet intake 16 to jet pump casing 20 are removed and the bracket attached with bolts or the existing studs through holes 56. Lever 62 is positioned on boat 10 at a point thought most convenient to the user and a push-pull cable 58 of appropriate length connected to lever 62 and stud 60 through bracket 48 and conduit 64.

With grill bar assembly 36 rotated into closed position, cable operated grill bar assembly is ready for use. During operation of the boat in shallow water rocks and other debris will inevitably become stuck in the grill bar screen between the interleaved stationary grill bars 24 and movable grill bars 38. When that condition is sensed by the operator, grill bar assembly 36 may be rotated into open position with lever 62 thereby doubling the space between the grill bars and allowing the debris to be dropped off and be washed out of the jet intake 16 under force the forward motion of the boat.

There is no need for the operator to stop the boat or get out of the boat and the clean-out of leaves and other such debris can even be done when the boat is on plane. However if rocks are likely stuck in the grill bar screen, putting the motor in neutral is prudent such that the rocks fall out and there is no chance they will be sucked into the impeller.

As previously mentioned, grill bar assembly 36 may be provided as original equipment on jet intake 16. In which case the jet intake 16 may be optionally sold with grill bar assembly 36 bolted in fixed position as a stationary grill. If a purchaser wants or later decides to have the option of operating grill bar assembly 36 as described above, push-pull cable 58, lever 62 and bracket 48 may be acquired and the fitting assembled as described above.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A debris protective fitting for a jet intake of an outboard jet motor, said debris protective fitting comprising a plurality of stationary grill bars supported in spaced substantially parallel disposition across the jet intake in front and rear slots, said front slots including empty front slots between adjacent grill bars;

a grill bar assembly comprising a plurality of movable grill bars supported in spaced substantially parallel disposition across the jet intake in the empty front slots in the jet intake and a heel plate that cups around a rear of the jet intake, a front cross pin passing through a front end of the stationary grill bars and the front end of the movable grill bars in the front slots and a rear cross pin passing through a rear end of the stationary grill bars in the rear slots; and, said heel plate configured for attachment to a push-pull cable for rotating the grill bar assembly around the front cross pin between open and closed position with respect to the jet intake.

2. The debris protective fitting of claim 1 including a push-pull cable wherein the heel plate is L-shaped with a toe and a spine, said movable grill bars welded in slots provided in the toe of the heel plate, a stud mounted generally on a centerline of the grill bar assembly and on an outboard side of the spine to which the push-pull cable is attached.

3. The debris protective fitting of claim 2 wherein the jet intake has a flange through which the jet intake is bolted to a jet pump casing of the outboard jet motor, said fitting including a bracket through which the push-pull cable passes, said bracket attached to the flange above the grill bar assembly and off centerline thereof to accommodate spatial requirement imposed by the jet pump casing.

4. The debris protective fitting of claim 3 wherein the push-pull cable between the bracket and the stud includes a swivel and is attached to the stud through a spherical rod end.

5. The debris protective fitting of claim 1 wherein the heel plate is a channel with a front wall, said front wall having slots in which the stationary bars are received when the grill bar assembly is rotated closed.

6. A debris protective fitting for a jet intake of an outboard jet motor mounted on a jet boat, said jet intake bolted to a jet pump casing of the outboard jet motor with a flange, said debris protective fitting comprising a plurality of stationary grill bars supported in spaced substantially parallel disposition across the jet intake in front and rear slots, said front slots including empty front slots between adjacent grill bars and each of an outermost stationary grill bar;

a grill bar assembly comprising a plurality of movable grill bars supported in spaced substantially parallel disposition across the jet intake in the empty front slots in the jet intake and a heel plate that cups around a rear of the jet intake, a front cross pin passing through a front end of the stationary grill bars and the front end of the movable grill bars in the front slots and a rear cross pin passing through a rear end of the stationary grill bars in the rear slots;

a push-pull cable attached to a stud mounted generally on a centerline of the grill bar assembly and on an outboard side of a heel plate for rotating the grill bar assembly around the front cross pin between open and closed position with respect to the jet intake;

said push-pull cable including a swivel and being attached to the stud through a spherical rod end; and, a lever for operating the push-pull cable from inside the boat.

7. The debris protective fitting of claim 6 wherein the lever is a hand lever with a tensioning adjustment.

8. The debris protective fitting of claim 6 wherein the bracket is Z-shaped with a spine and upper and lower arms, said upper arm is angled downwardly and rotated with respect to the spine such that the push-pull cable applies a substantially vertical force on the grill bar assembly.

9. A debris protective fitting for a jet intake in an outboard jet motor mounted on a boat, said jet intake bolted to a jet pump casing of the outboard jet motor with a flange, said debris protective fitting comprising a plurality of stationary grill bars supported in spaced substantially parallel disposition across the jet intake in front and rear slots, said front slots including empty front slots between adjacent grill bars and each of an outermost stationary grill bar;

a grill bar assembly comprising a plurality of movable grill bars supported in spaced substantially parallel disposition across the jet intake in the empty front slots in the jet intake and a heel plate that cups around a rear of the jet intake, a front cross pin passing through a front end of the stationary grill bars and the front end of the movable grill bars in the front slots and a rear cross pin passing through a rear end of the stationary grill bars in the rear slots;

a push-pull cable attached to a stud mounted generally on a centerline of the grill bar assembly and on an outboard side of a heel plate for rotating the grill bar assembly around the front cross pin between open and closed position with respect to the jet intake;

said heel plate being a channel with a front wall, said front wall having open slots between slots in which the movable grill bars are welded, a rear end of the stationary grill bars received in the open slots and notched to allow the grill bar assembly to close all the way against the jet intake; and, a hand lever with a tensioning adjustment for operating the push-pull cable from inside the boat.

10. The debris protective fitting of claim 9 wherein the movable grill bars aligned with the empty front slots in the jet intake are configured such that they only partly enter the empty front slots.

* * * * *